US005964612A

United States Patent [19]

Hatagishi

[11] Patent Number: 5,964,612

[45] Date of Patent: Oct. 12, 1999

[54] PRESSURE CONNECTING TERMINAL

[75] Inventor: Yuji Hatagishi, Shizuoka, Japan

[73] Assignee: Yazaki Corporation, Tokyo, Japan

[21] Appl. No.: 08/995,142

[22] Filed: Dec. 19, 1997

[30] Foreign Application Priority Data

Dec. 26, 1996 [JP] Japan ..... 8-348270

[51] Int. Cl.[6] ..... H01H 4/24

[52] U.S. Cl. ..... 439/397; 439/387

[58] Field of Search ..... 439/387, 391, 439/395, 396, 397, 398, 399, 417, 421, 430, 437, 442

[56] References Cited

U.S. PATENT DOCUMENTS

| | | | |
|---|---|---|---|
| 4,527,852 | 7/1985 | Dechelette | 439/397 |
| 4,699,441 | 10/1987 | D'Urso et al. . | |
| 4,806,120 | 2/1989 | Baker | 439/399 |
| 5,073,126 | 12/1991 | Kikuchi et al. | 439/452 |
| 5,380,218 | 1/1995 | Yamamoto et al. | 439/397 |
| 5,554,046 | 9/1996 | Sugiyama et al. . | |

FOREIGN PATENT DOCUMENTS

| | | |
|---|---|---|
| 4-15159 | 2/1992 | Japan . |
| WO 96/33523 | 10/1996 | WIPO . |

*Primary Examiner*—Lincoln Donovan
*Attorney, Agent, or Firm*—Sughrue, Mion, Zinn, Macpeak & Seas, PLLC

[57] ABSTRACT

A pressure-connecting terminal 1 includes: a bottom wall 1*d;* a pair of side walls 1*e* bent from the bottom wall 1*d* so as to confront each other; and a pressure-connecting portion 1*b* having pressure-connecting blades 1*f* formed on either one or both of the bottom wall 1*d* and the side walls 1*e* so that the pressure-connecting blades can form pressure-connecting slots 1*h* while bent inward. The pressure-connecting terminal 1 allows the pressure-connecting blades 1*f* to rip off an insulating layer 2*b* of a sheathed wire 2 to be connected to a conductor 2*a* of the sheathed wire 2 with the sheathed wire 2 press-connected into the pressure-connecting slots 1*h*. In such pressure-connecting terminal 1, beads 1*g* are formed over corner portions continuously extending from the pressure-connecting blades 1*f* to either the side walls 1*e* or the bottom wall 1*d* so as to protrude inward from outside.

4 Claims, 4 Drawing Sheets

PRESSURE CONNECTING TERMINAL

BACKGROUND OF THE INVENTION

The invention relates to a pressure-connecting terminal that allows pressure-connecting blades thereof to rip off the insulating layer of a sheathed wire to be connected to the conductor of the sheathed wire by press-connecting the sheathed wire into pressure-connecting slots thereof.

FIG. 1 shows a conventional pressure-connecting terminal 10 disclosed in Unexamined Japanese Utility Model Publication No. Hei. 4-15159. The pressure-connecting terminal 10 is designed so that pressure-connecting blades 10*d* and pressure-connecting blades 10*e* rip off an insulating layer 11*a* of a sheathed wire 11 to be connected to a conductor 11*b* of the sheathed wire 11. That is, the sheathed wire 11 is laid horizontal between a pair of side walls 10*c* so as to be press-connected from above, the side walls 10*c* being bent from a bottom wall 10*b* of a pressure-connecting portion 10*a* so as to confront each other. As a result, the pressure-connecting blades 10*e* that form a U-shaped pressure-connecting slot 10*f* while bent inward from the side walls 10*c* and the pressure-connecting blades 10*d* that form a pressure-connecting slot 10*g* while bent inward from the bottom wall 10*b* rip off the insulating layer 11*a* to be connected to the conductor 11*b*.

However, the conventional pressure-connecting terminal 10 addresses the inconvenience that the power of the pressure-connecting portion 10*a* for holding the sheathed wire 11 is reduced. That is, as shown in FIGS. 2 and 3, if a tensile force F is applied in an axial direction from the sheathed wire 11 to the pressure-connecting blades 10*d*, 10*e* that have bitten into the sheathed wire 11, e.g., as in the case where the sheathed wire 11 is pulled in an-axial direction with one end of the sheathed wire being fixed by the pressure-connecting portion 10*a* after the sheathed wire has been pressured, the pressure-connecting blades 10*d*, 10*e* are bent or fallen off, and such deformation of the pressure-connecting blades 10*d*, 10*e* leads to the aforementioned reduction in holding power.

To overcome this inconvenience, one may increase strength by increasing the thickness of the pressure-connecting terminal 10 or by providing a reinforcing member that bridges between the bent inner sides of the base portions of the bent pressure-connecting blades 10*d*, 10*e*. However, if the thickness of the pressure-connecting terminal is increased, the weight of the pressure-connecting terminal is also increased, whereas if a reinforcing member is arranged, the problem that the manufacturing process becomes complicated in the sense that a separate reinforcing member must be additionally provided on the small-sized pressure-connecting terminal 10.

SUMMARY OF THE INVENTION

It is an object of the invention to provide a pressure-connecting terminal that can hold a sheathed wire with the pressure-connecting portion thereof appropriately by increasing the rigidity of the pressure-connecting blades thereof even if a tensile force is applied from the sheathed wire in an axial direction to the pressure-connecting blades.

The object can be attained by a pressure-connecting terminal, according to the present invention, that includes: a bottom wall; a pair of side walls being bent from the bottom wall so as to confront each other; and a pressure-connecting portion having pressure-connecting blades on either one or both of the bottom wall and the side walls so that the pressure-connecting blades form pressure-connecting slots while bent inward, the pressure-connecting terminal allowing the pressure-connecting blades to rip off an insulating layer of a sheathed wire to be connected to a conductor of the sheathed wire when the sheathed wire is press-connected into the pressure-connecting slots. In such pressure-connecting terminal, beads are formed over corner portions continuously extending from the pressure-connecting blades to the side walls or the bottom wall so as to protrude inward from outside.

According to the above-mentioned terminal of the present invention, the rigidity of the pressure-connecting blades is increased by the beads that are formed over the corner portions continuously extending from the pressure-connecting blades to the side walls or the bottom wall so as to protrude inward from outside. As a result, even if a tensile force is applied in an axial direction from the sheathed wire to the pressure-connecting blades with the sheathed wire having been pressured onto the pressure-connecting blades, the pressure-connecting blades are hard to deform in the direction of the tensile force and can, therefore, hold the sheathed wire appropriately.

In the above-mentioned -construction of the present invention, it is preferable that the pressure-connecting blades are formed so as to be bent from both of the pair of side walls; and the beads are formed over corner portions continuously extending from both pressure-connecting blades to the pair of side walls.

According to the above-mentioned construction, the sheathed wire can be held stably from both sides thereof by the pressure-connecting blades, in addition to the operation performed by the aforementioned invention.

Further, in the above-mentioned construction, it is further preferable that the pressure-connecting blades formed so as to be bent from both side walls are paired so as to extend in an axial direction at a distance from each other along the side walls.

According to the above-mentioned construction, a plurality of pressure-connecting blades can operate onto the sheathed wire in the axial direction, in addition to the operation performed by the aforementioned invention.

DETAILED DESCRIPTION OF THE PREFERRED EMBODIMENTS

Hereinafter, a preferred embodiment according to the present invention will be described in detail with reference to the drawings.

Figure 1:
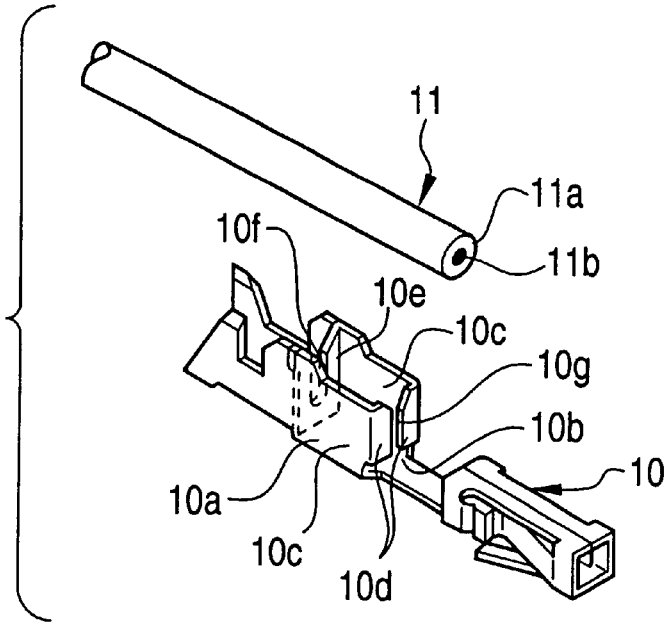
FIG. 1 PRIOR ART
FIG. 1 is a perspective view showing a condition before a conventional pressure-connecting terminal is connected to a sheathed wire.
Figure 2:
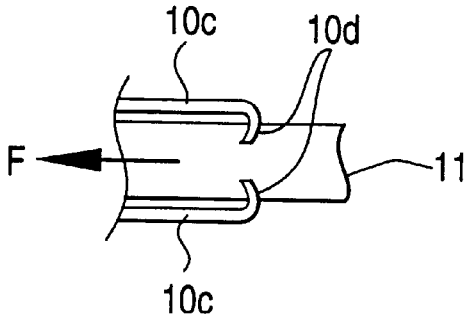
FIG. 2 PRIOR ART
FIG. 2 is a diagram illustrative of a conventional operation.
Figure 3:
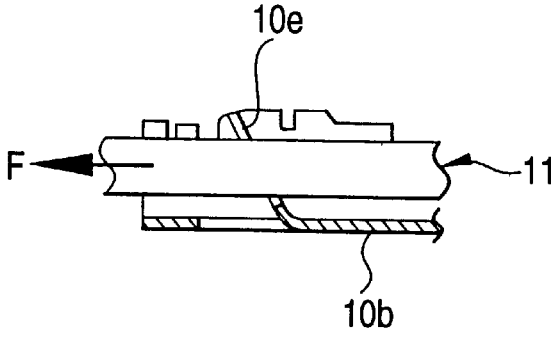
FIG. 3 PRIOR ART
FIG. 3 is a diagram illustrative of a conventional operation.
Figure 4:
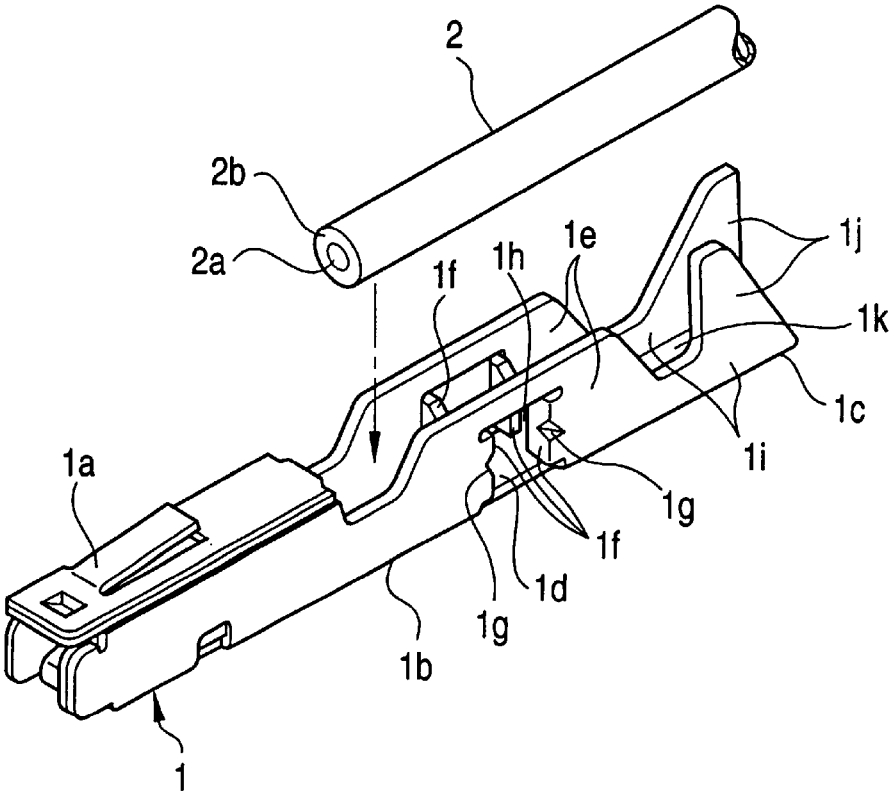
FIG. 4 is a perspective view showing a condition before a pressure-connecting terminal, which is a preferred embodiment according to the present invention, is connected to a sheathed wire.
Figure 5:
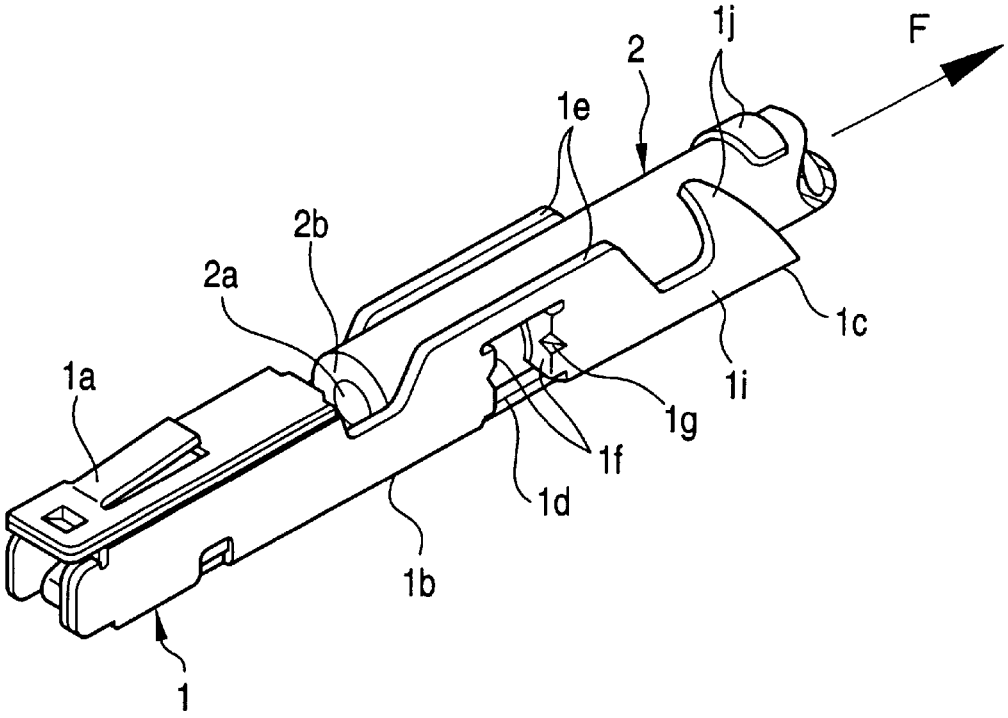
FIG. 5 is a perspective view showing the embodiment after the pressure-connecting terminal according to the present invention shown in FIG. 4 is connected to the sheathed wire.
Figure 6:
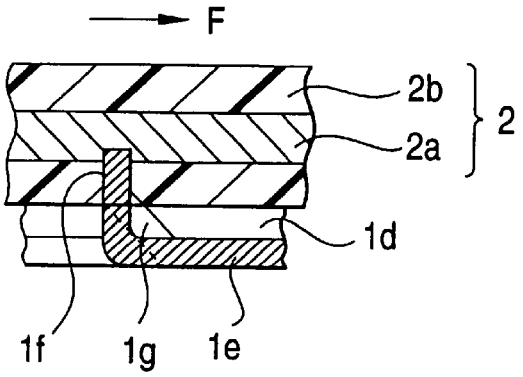
FIG. 6 is a sectional view showing a main portion of the embodiment according to the invention shown in FIG. 5.

In FIGS. 4 to 6, reference numeral 1 denotes a pressure-connecting terminal, which is formed by press-working a conductive plate member into such a shape that a connecting portion 1*a*, a pressure-connecting portion 1*b*, and a caulking portion 1*c* are arranged continuously from one side to the other. The connecting portion 1*a* connects a not shown mating terminal thereto. The pressure-connecting portion 1*b* pressures a sheathed wire 2 that has a conductor 2*a* sheathed by an insulating layer 2*b*. The caulking portion 1*c* caulks the sheathed wire 2.

In this embodiment according to the present invention, the pressure-connecting portion 1*b* includes: a bottom wall 1*d*: a pair of side walls 1*e* that are bent from the bottom wall 1*d* so as to confront each other; pressure-connecting blades 1*f* that are bent from these side walls 1*e* so as to open like French doors; and beads 1*g* that are formed over corner portions continuously extending from the side walls 1*e* to the pressure-connecting blades 1*f* so as to protrude inward from outside. Pressure-connecting slots 1*h* are formed between the pressure-connecting blades 1*f* extending from the side wall 1*e* on one side and the pressure-connecting blades 1*f* extending from the side wall 1*e* on the other side.

The caulking portion 1*c* has a bottom wall 1*k* and a pair of side walls 1*i* that are extended from the bottom wall 1*d* and the pair of side walls 1*e* of the pressure-connecting portion 1*b*, forming caulking pieces 1*j* that are erect alternately.

According to the structure of the embodiment of the invention, an end portion of the sheathed wire 2 is press-connected into the pressure-connecting slots 1*h* horizontal from above between the side walls 1*i* of the caulking portion 1*c* and the side walls 1*e* of the pressure-connecting portion 1*b*, so that the pressure-connecting blades 1*f* rip off the insulating layer 2*b* of the sheathed wire 2 to be connected to the conductor 2*a* while biting into the conductor 2*a*.

Then, by bending the caulking pieces 1*j* of the caulking portion 1*c* projecting upward from the sheathed wire 2 inward to each other using a not shown tool, the sheathed wire 2 is supported so as to be crimped by the caulking pieces 1*j*.

Even if a tensile force F is applied in an axial direction shown in FIG. 5 from the sheathed wire 2 to the pressure-connecting blades 1*f* under this condition, e.g., as in the case where the sheathed wire 2 is pulled from the pressure-connecting terminal 1, the rigidity given by the beads 1*g* makes the pressure-connecting blades 1*f* hard to deform in the direction of the tensile force F. As a result, the sheathed wire 2 can be held by the pressure-connecting portion 1*b* appropriately.

Further, the pressure-connecting blades 1*f* whose rigidity has been increased by the beads 1*g* can hold the sheathed wire 2 stably from both sides of the sheathed wire.

Furthermore, the pressure-connecting blades 1*f* whose rigidity has been increased can hold the sheathed wire 2 more strongly while extending at a distance from each other in the axial direction along the pair of side walls 1*e*.

While the pressure-connecting blades 1*f* are bent from the respective side walls 1*e* in the aforementioned embodiment, similar operation and advantageous effects can be obtained by bending not shown pressure-connecting blades inward from the bottom wall 1*d*, or by bending not shown pressure-connecting blades inward from both the side walls 1*e* and the bottom wall 1*d*.

Figure 7:
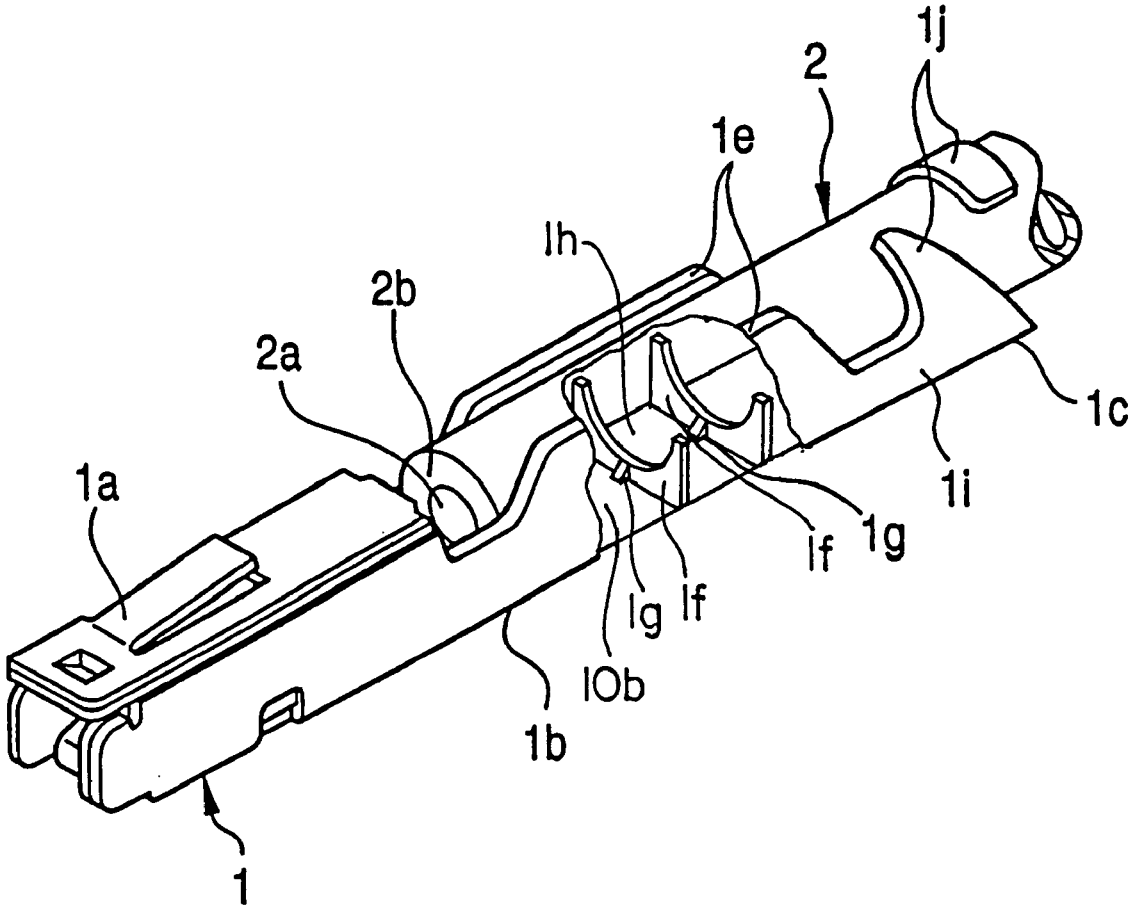
FIG. 7 is a perspective view showing another embodiment of the pressure-connecting terminal according to the present invention.

Furthermore, FIG. 7 illustrates another embodiment, where the pressure-connecting blades 1*f* are bent from the bottom wall 10*b* to form pressure-connecting slots 1*h*. In addition, there are beads 1*g* that extend from the pressure connecting blade 1*f* to the bottom wall 10*b*. As previously set forth, the beads increase the rigidity in the pressure-connecting blades, making the pressure-connecting blades 1*f* hard to deform in the direction of a tensile force.

As described in the foregoing, the invention provides the following advantageous effects.

According to the invention, the rigidity of the pressure-connecting blades is increased by the beads that are formed over the corner portions continuously extending from the pressure-connecting blades to the side walls or the bottom wall so as to protrude inward from outside. As a result, even if a tensile force is applied in an axial direction to the pressure-connecting blades that have bitten into the sheathed wire with the sheathed wire having been pressured onto the pressure-connecting blades, the pressure-connecting blades are hard to deform in the direction of the tensile force and can, therefore, hold the sheathed wire appropriately without increasing the thickness of the pressure-connecting terminal or providing independent reinforcing members.

According to the invention, the sheathed wire can be held stably from both sides thereof by the pressure-connecting blades.

According to the invention, the sheathed wire can be held strongly by the pressure-connecting blades.

While there has been described in connection with the preferred embodiment of the invention, it will be obvious to those skilled in the art that various changes and modifications may be made therein without departing from the invention, and it is aimed, therefore, to cover in the appended claim all such changes and modifications as fall within the true spirit and scope of the invention.

What is claimed is:

1. A pressure-connecting terminal comprising:

a bottom wall;

a pair of side walls extending upwardly from the bottom wall so as to confront each other; and a pressure-connecting portion having pressure-connecting blades extending inwardly from the side walls, respectively, so that the pressure-connecting blades form a pressure-connecting slot, the pressure-connecting terminal allowing the pressure-connecting blades to tear an insulating layer of a sheathed wire to be connected to a conductor of the sheathed wire when the sheathed wire is press-connected into the pressure-connecting slot, wherein beads are formed on the inside of corner portions respectively defined by the pressure-connecting blades and the side walls so as to reinforce said pressure-connecting blades.

2. A pressure-connecting terminal according to claim 1, wherein each one of said side walls has a pair of pressure-connecting blades extending inwardly therefrom so that said pressure-connecting blades form a pair of opposing pressure-connecting slots.

3. A pressure-connecting terminal according to claim 2, wherein said pair of opposing pressure-connecting slots are spaced a predetermined distance from each other in the axial direction along said side walls.

4. A pressure-connecting terminal comprising:

a bottom wall;

a pair of side walls extending upwardly from the bottom wall so as to confront each other; and a pressure-connecting portion having pressure-connecting blades extending inwardly from said bottom wall, so that the pressure-connecting blades form a pressure-connecting slot, the pressure-connecting terminal allowing the pressure-connecting blades to tear an insulating layer of a sheathed wire to be connected to a conductor of the sheathed wire when the sheathed wire is press-connected into the pressure-connecting slot, wherein a bead is formed over a corner portion continuously extending from each of the pressure-connecting blades to the bottom wall so as to reinforce said pressure-connecting blades.

* * * * *